US009855647B2

(12) United States Patent
Johansson

(10) Patent No.: US 9,855,647 B2
(45) Date of Patent: Jan. 2, 2018

(54) PERCUSSION DEVICE FOR A HYDRAULIC ROCK DRILLING MACHINE, METHOD OF OPERATION OF A PERCUSSION DEVICE AND HYDRAULIC ROCK DRILLING MACHINE INCLUDING A PERCUSSION DEVICE

(71) Applicant: Atlas Copco Rock Drills AB, Orebro (SE)

(72) Inventor: Thomas Johansson, Orebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 434 days.

(21) Appl. No.: 14/441,265

(22) PCT Filed: Oct. 30, 2013

(86) PCT No.: PCT/SE2013/051265
§ 371 (c)(1),
(2) Date: May 7, 2015

(87) PCT Pub. No.: WO2014/084772
PCT Pub. Date: Jun. 5, 2014

(65) Prior Publication Data

US 2015/0290788 A1 Oct. 15, 2015

(30) Foreign Application Priority Data

Nov. 28, 2012 (SE) ..... 1251341

(51) Int. Cl.
*B25D 9/26* (2006.01)
*B25D 9/12* (2006.01)

(52) U.S. Cl.
CPC ..... *B25D 9/26* (2013.01); *B25D 9/12* (2013.01); *B25D 2250/131* (2013.01); *B25D 2250/231* (2013.01)

(58) Field of Classification Search
CPC ..... B25D 9/26; B25D 9/12; B25D 17/245; B25D 9/18; E21B 4/14
(Continued)

(56) References Cited

U.S. PATENT DOCUMENTS 4,084,486 A * 4/1978 Juvonen ..... B25D 9/12 91/276
4,413,687 A * 11/1983 Eklof ..... B25D 9/12 173/207

(Continued)

FOREIGN PATENT DOCUMENTS

| | | |
|---|---|---|
| EP | 0 648 915 | 4/1995 |
| FR | 2 139 398 | 1/1973 |
| WO | WO2011/139208 | 11/2011 |

*Primary Examiner* — Nathaniel Chukwurah
(74) *Attorney, Agent, or Firm* — Mark P. Stone

(57) ABSTRACT

A percussion device for a hydraulic rock drilling machine (1) including, inside a cylinder (4), a to and fro moveable impact piston (3), which is provided with a land portion (12) for cooperation with a braking recess (11) in the cylinder (4) for the establishment of a braking chamber in advanced positions of the impact piston, wherein a throttle slit (17) is arranged to be established between the land portion (12) and the braking recess (11). A pressure channel (14), being connected to a pressure medium source, is arranged to debouch in the cylinder (4) between the piston guiding device (6) and a position of the land portion (12) in a most advanced position of the impact piston (3). The invention also concerns a method and a hydraulic rock drilling machine.

20 Claims, 2 Drawing Sheets

(58) Field of Classification Search
USPC ..... 173/207, 208, 206, 138; 175/296
See application file for complete search history.

(56) References Cited

U.S. PATENT DOCUMENTS

| | | | | |
|---|---|---|---|---|
| 4,624,325 | A | 11/1986 | Steiner | |
| 5,002,136 | A * | 3/1991 | Barthomeuf | B25D 9/12 173/114 |
| 5,653,295 | A * | 8/1997 | Juvonen | B25D 9/145 173/207 |
| 5,893,419 | A * | 4/1999 | Hodges | B25D 9/12 173/13 |
| 7,410,010 | B2 * | 8/2008 | Henriksson | B25D 9/18 173/128 |
| 7,410,015 | B2 * | 8/2008 | Denoix | E21B 10/32 175/263 |
| 7,419,015 | B2 | 9/2008 | Muuttonen et al. | |
| 7,681,664 | B2 * | 3/2010 | Patterson | B25D 9/18 173/207 |
| 2009/0223720 | A1 * | 9/2009 | Patterson | B25D 17/245 175/296 |

* cited by examiner

PERCUSSION DEVICE FOR A HYDRAULIC ROCK DRILLING MACHINE, METHOD OF OPERATION OF A PERCUSSION DEVICE AND HYDRAULIC ROCK DRILLING MACHINE INCLUDING A PERCUSSION DEVICE

FIELD OF THE INVENTION

The invention relates to a percussion device for a hydraulic rock drilling machine including a to and fro moveable impact piston, which is provided with a land portion for co-operation with a braking recess in advanced positions of the impact piston relative to a normal impact position, wherein a throttle slit is established between wall portions of the land portion and the braking recess, and wherein the percussion device includes a piston guiding device which is positioned in front of the braking recess. The invention also relates to a hydraulic rock drilling machine including such a percussion device.

BACKGROUND OF THE INVENTION

It is previously known in percussion devices for hydraulic rock drilling machines to provide the cylinder of the percussion device with a brake recess. In certain operational conditions a land portion of the impact piston of the percussion device enters this brake recess for the establishment of a braking chamber. Such operational conditions are when the shank adapter of the percussion device because of reduced resistance has been displaced forward in the impact direction, such that the strike of the impact piston against the shank adapter no longer occurs within the region of a desired impact position.

The aim of arranging a brake recess in the cylinder and the co-operating land portion on the impact piston for then establishment of a braking chamber is to decelerate the impact piston in order to at least limit the intensity of impacts against the shank adapter in too far advanced positions thereof. Such impacts otherwise risk resulting in damaging the drilling machine.

The brake recess, which is filled with hydraulic medium, is subjected to an instantaneous pressure increase when a land portion on the impact piston enters therein, resulting in that hydraulic medium under pressure is transmitted on the one hand over a throttling slot being established between wall portions of the land portion and the braking recess, on the other hand forward from the established braking chamber towards and passed the piston guiding device to a draining chamber which is optionally arranged in front of the piston guiding device.

Further, after contact of the impact piston with the shank adapter, a fast return movement of the impact piston will occur, leading to cavitation in the hydraulic medium in the established braking chamber and all the way in between the impact piston and the piston guiding device. This risks damaging the piston guiding device, which usually is made from a relatively soft bearing material.

In order to reduce these problems it has been suggested to form the land portion with a surrounding flange and to form the braking recess correspondingly larger such that a greater volume of oil is activated during braking. This results in a lower pressure in the established braking chamber and thereby reduced damages to the piston guiding device and the seals. The previously known solution also allows the throttle slit between the land flange and the co-operating wall portion of the braking recess to be formed with somewhat increased area, which in turn reduces cavitation risks in case of a rebounding impact piston.

AIM AND MOST IMPORTANT FEATURES OF THE INVENTION

The background art referred to reduces the above problems but brings along some other drawbacks such as increased cylinder dimensions, which is intended to be addressed with the present invention.

The aim of the present invention is to provide a percussion device as mentioned initially wherein the problems of the background art are at least reduced and wherein an effective and economically manufactured percussion device is obtained.

This aim is obtained according to the invention with a percussion device as mentioned initially in that a pressure channel, being connected to a pressure medium source, is arranged to debouch in the cylinder between the piston guiding device and the land portion in a position thereof in a most advanced position of the impact piston.

Hereby the drawbacks of the above described background art are avoided since the inventive percussion device becomes more energy-effective because a land flange consuming energy when its moves as a part of the impact piston during normal drilling can be avoided. Better drilling efficiency can thereby be expected with the inventive percussion device. The invention allows more effective reduction of cavitation problems that after all partly remain in respect of devices according to the closest background art.

Such advanced positions occur during so called idle strikes of the percussion device and can also occur during drilling when a cavity or weak rock is met, and for example when the drilling machine is used for scaling purposes. The shank adapter has then advanced forward from its normal position during normal drilling.

It should be noted that with the expression: "a pressure channel connected to a pressure medium source is arranged to debouch in the cylinder" is intended that the pressure channel can open in the cylinder via a room or a recess and not that the pressure channel necessarily has an opening in the very surface of the cylinder receiving the impact piston.

With the expression: "most advanced position of the impact piston" is intended a position which is either limited purely mechanically, in that the shank adapter has reached a position against a stop in the rock drilling machine housing or in any other way is a most advanced position (as seen in the impact direction) that can be reached by the impact piston. Hereby is ensured that an opening of the pressure channel in the cylinder e.g. does not risk being blocked by a portion of the impact piston in any position of the impact piston.

Through the invention is achieved a pressure equalization in the region between the land portion, in its most advanced position, and the piston guiding device. Since further the invention in practice results in supply of hydraulic medium, it is achieved that cavitation in the region of the piston guiding device is reduced. Hereby also the working life of the piston guiding device can be expected to increase because of enhanced lubrication.

It is preferred that the pressure channel is arranged to debouch in an equalizing chamber being arranged between the braking recess and the piston guiding device, since this arrangement in an effective way reduces cavitation at the piston guiding device as well as also reduces pressure peaks affecting the sealing device. Altogether, according to this aspect of the invention increased working life of the piston guiding device and the piston seal is obtained. Compared to the background art, also best efficiently is obtained since the land portion can be formed with a small radial extension. In particular it is preferred that the equalizing chamber is ring-shaped.

The region of the cylinder between the braking recess and the equalizing chamber is suitably formed with such a slit that a slit throttling is formed vis-à-vis the impact piston in order to obtain an effective energy absorption at the same time as a certain oil flow could occur from the equalizing chamber to the braking recess during the movement of the impact piston opposite to the impact direction.

It is preferred that the braking recess, the piston guiding device and the equalizing chamber are arranged in a piston guiding unit being arranged in a housing of the rock drilling machine. This simplifies manufacture and makes manufacture more economic with maintained strict tolerances. Suitably also a draining chamber and impact piston seals are arranged in the piston guiding unit.

As a variant, the pressure channel is instead arranged to debouch in a region of the braking recess being positioned most closely to the piston guiding device. This arrangement is less effective than the above described but has i.a. the advantage of reduced machining effort and the possibility of reduced machine length. Suitably, in the pressure channel there is arranged a one way valve which is open in a direction of a mouth in the braking recess in order to avoid an intentional draining in this region and in order to ensure that the brake pressure is maintained at an expected level.

The pressure medium source suitably any one from the group: a drive chamber in the percussion device, which is normally preferred because of essentially direct accessibility, a supply channel for percussion pressure, which is suitable in case it is desired to avoid oil take out from the drive chamber, a separate high pressure generator, which gives certain regulating possibilities.

The provision of a regulating device in order to regulate pressure and/or flow in the pressure channel makes adjustment to different operational situation possible.

In an embodiment, the land portion co-operating with the braking recess includes a radially extending land flange, which results in reduced pressure build-up in the braking recess but also risk for increased radial dimensions of the cylinder.

The invention also concerns a corresponding method for the operation of a percussion device of a hydraulic rock drilling machine, wherein hydraulic medium from a pressure medium source is supplied in the cylinder between the piston guiding device and a position of the land portion in a most advanced position of the impact piston.

Method features corresponding to the above subordinate device features are applicable for variants of this method.

BRIEF DESCRIPTION OF DRAWINGS

The invention will now be described in greater detail by way of embodiments and with reference to the annexed drawings, wherein.

DESCRIPTION OF EMBODIMENTS

Like and similar elements have in some cases been given same reference signs.

Figure 1:
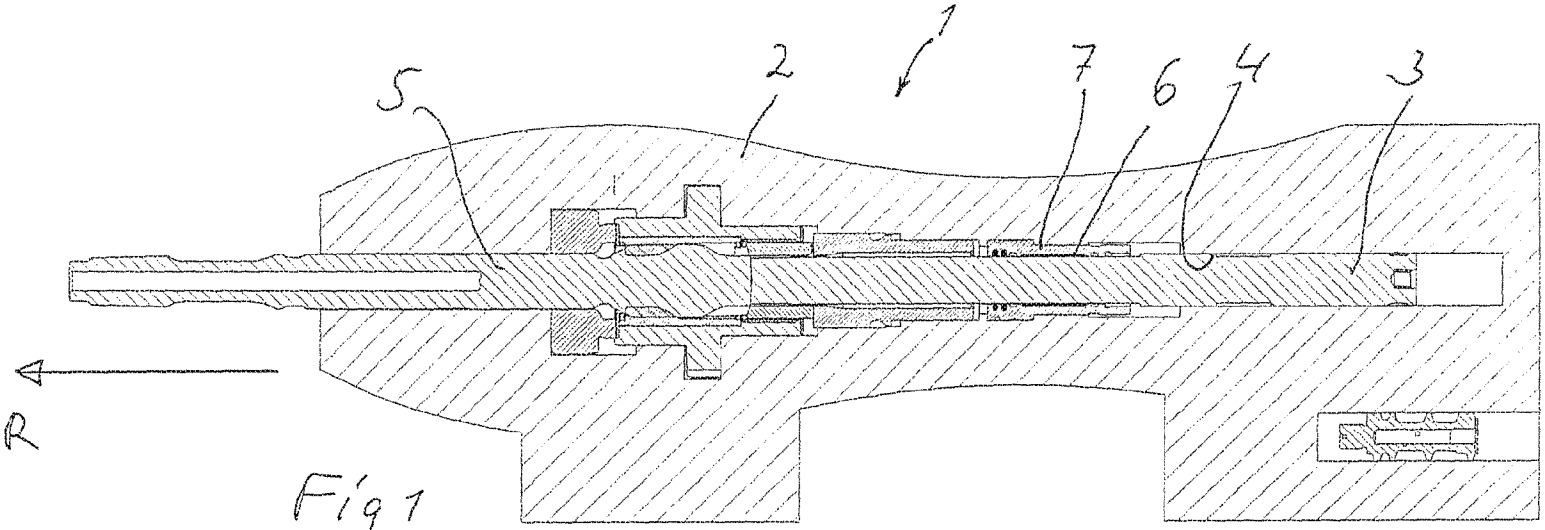
FIG. 1 shows a part section of a hydraulic rock drilling machine equipped with a percussion device according to the invention in a sectional view.

FIG. 1 shows in a sectional view a hydraulic rock drilling machine 1 including a housing 2, wherein an impact distance 3 is moveable to and fro inside the cylinder 4. The impact piston 3 acts against a shank adapter 5 and is guided by a piston guiding device 6, which is part of a piston guiding unit 7. The rock drilling machine 1 as usual also includes i.a. a damping device and a rotation device etc., which are, however, not subject of the present invention and are therefore not further described here.

Figure 2:
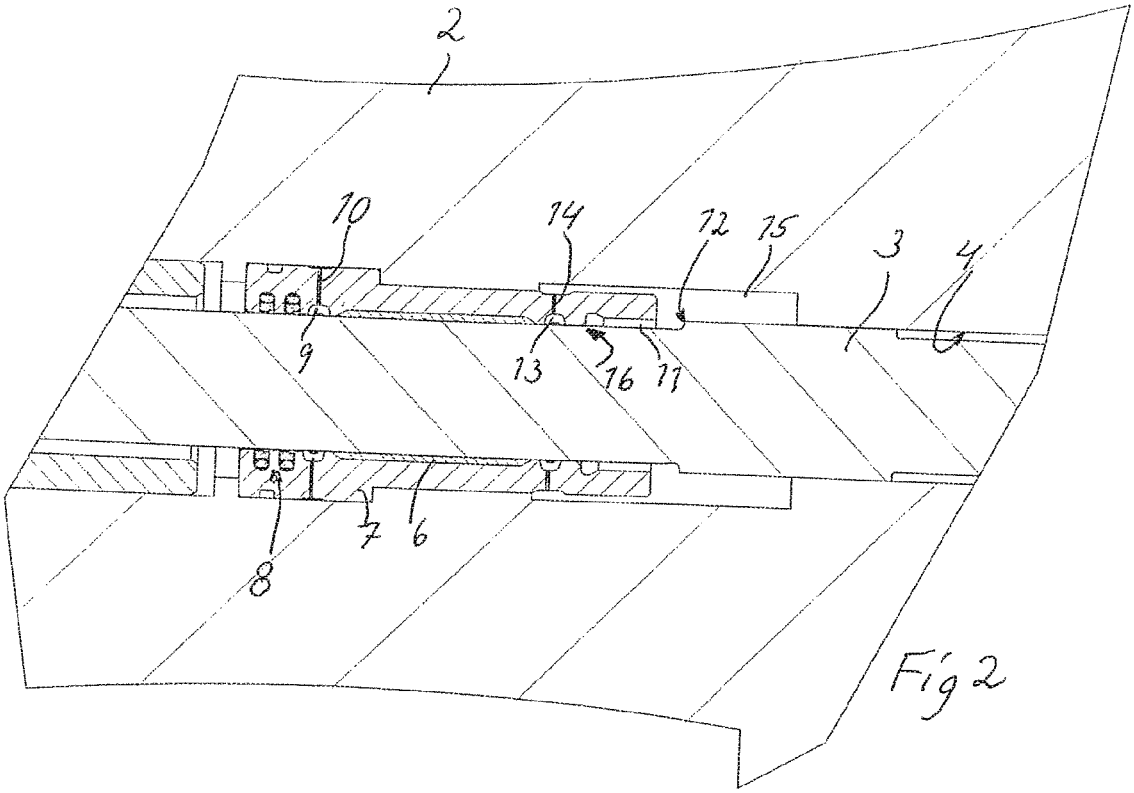
FIGS. 2 and 3 show a detail of the sectional view in FIG. 1 in a large scale with an impact piston in different positions.

In FIG. 2 is shown the arrangement around the piston guiding device 6 in respect of the present invention in greater detail. The piston guiding device 6 is thus in this embodiment part of said piston guiding unit 7, which suitably is comprised of a integral component which besides the piston guiding device 6 includes a number of other elements such as a braking recess 11. The braking recess 11 is comprised of a ring-shaped room which has a circular cylindrical outer envelope surface and is open in a direction opposite to an impact direction R of the impact piston 3.

The braking recess 11 is arranged to co-operate with a land portion 12 being shaped as a radial extension of the impact piston 3 in advanced position of the impact piston 3 for establishment of a braking chamber.

The piston guiding unit 7 further includes an equalizing chamber 13, which is arranged between the braking recess 11 and the piston guiding device 6 and which communicates with a permanently pressurized drive chamber 15 arranged for return strokes of the impact piston 3. A pressure channel 14 is provided for ensuring a supply of hydraulic medium from the drive chamber 15 to the equalizing chamber 13.

As seen in the impact direction R in front of the piston guiding device 6, there is a draining chamber 9, also being received by the piston guiding unit 7, for draining hydraulic medium/pressure medium escaping passed the piston guiding device 6. In front of the draining chamber 9, as seen in said impact direction R, is further positioned a sealing device 8, which in this embodiment includes two axially separated piston seals. Other configurations of the sealing device can exist.

In FIGS. 1 and 2 is shown the approximate position of the impact piston during normal drilling operation of the rock drilling machine when, because of a prevailing desired impact position of the impact piston, the land portion 12 does not enter into the braking recess 11.

Figure 3:
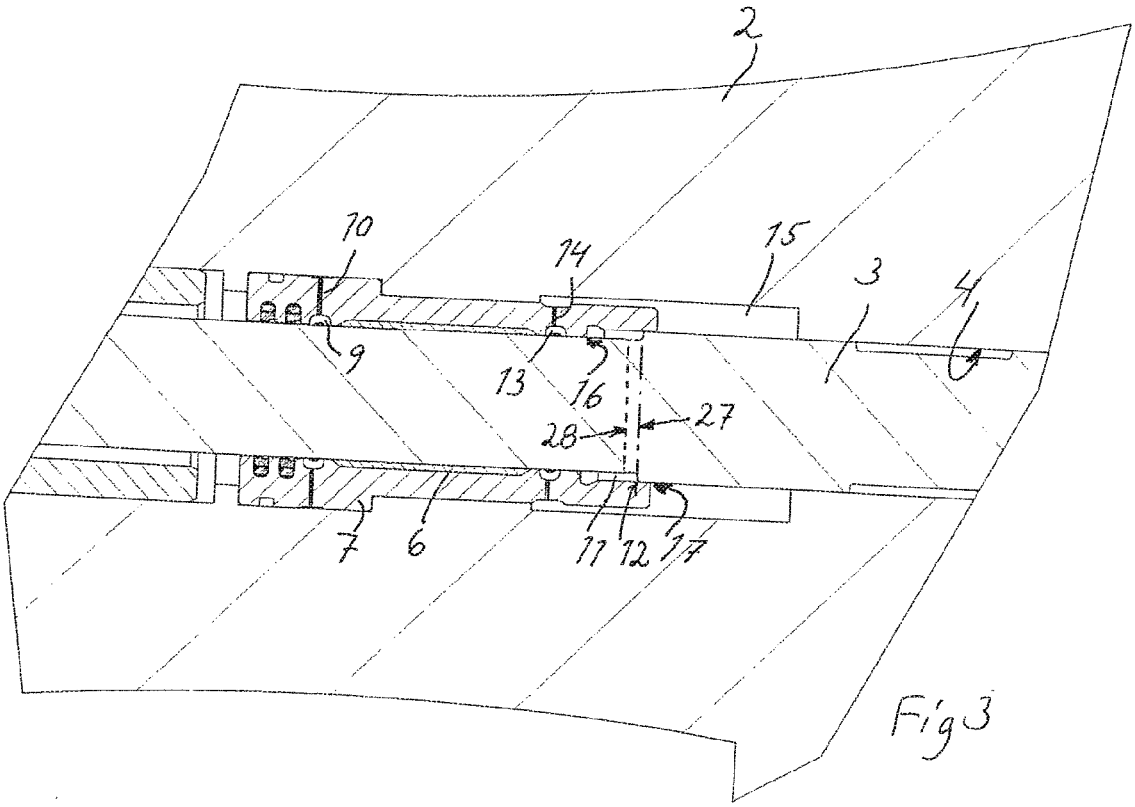

In FIG. 3 is shown the region of the piston guiding device 6 with the land portion 12 in an advanced position 27 (clarified with dot-interrupted line), wherein a throttle slit 17 is established between wall portions of the land portion 12 and the braking recess 11.

Such advanced positions occur during idle strikes of the percussion device and can also occur during drilling when the drill bit meets a cavity or weak rock, and for example when the rock drilling machine is used for scaling purposes. The shank adapter has then been able to advance forward in the impact direction from its normal position during normal drilling operation.

When the land portion 12 of the impact piston enters into the braking recess 11 and the braking chamber is established, a high pressure is formed aiming to decelerate the impact piston. This high pressure leads to the escape of hydraulic medium from the braking recess on the one hand through the throttle slit 17, on the other hand through a throttle slit 16 formed between the impact piston 3 and an inwardly directed ring surface between the braking recess and the adjacent equalizing chamber 13.

With an interrupted line at 28 is in FIG. 3 illustrated the position of the land portion 12 in the most advanced position of the impact piston which is limited purely mechanically in that the shank adapter has reached a position with contact against a stop in the housing of the rock drilling machine.

Through the pressure medium supplied equalizing chamber 13, potential pressure peaks emanating from the entry of the land portion into the braking recess are effectively reduced, pressure peaks that would otherwise be harmful for the sealing device. Further is achieved, through supplying hydraulic medium through the pressure channel 14, that cavitation effects on the piston guiding device are effectively reduced during return strokes of the impact piston.

As an alternative to being comprised of an integral component, the piston guiding unit can be comprised of plural, for example two, three or more parts which together are insertable into the cylinder. Each one of these parts can exhibit one or more of the different elements: the piston guiding device 6, the braking recess 11, the draining chamber 9, the sealing device 8 and the equalizing chamber 13.

Figure 4:
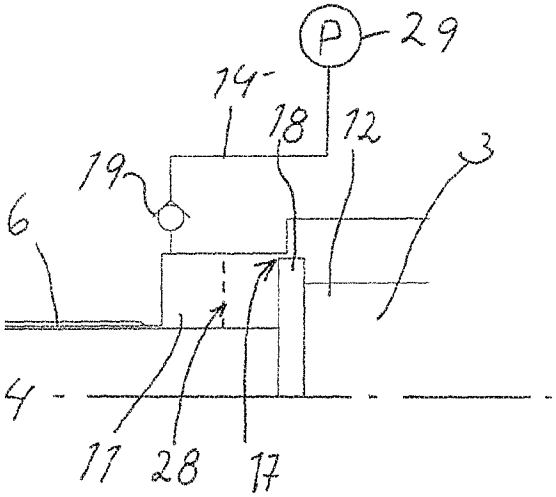
FIG. 4 shows diagrammatically a detail of another embodiment of the invention.

In FIG. 4 is illustrated a second embodiment of the invention, wherein no equalizing chamber is arranged, but instead the pressure channel 14', which in this case communicates with the separate high pressure generator 29, debouches in a forward region of the braking recess 11 itself. This region is in front of a position where the land portion 12 is in its most advanced position of the impact piston according to the above. This position is indicated with an interrupted line at 28. The equalized and in particular cavitation suppressing action of the inventive device occurs through the continuously provided support of hydraulic medium in this region of the braking recess 11.

In the variant in FIG. 4, the land portion 12 has been provided with a land flange 18, which is possible but not necessary to use in a device according to the invention.

19 indicate a one way valve, which is positioned in the pressure channel 14' in order to prevent a back-flow of hydraulic medium during the instantaneous pressure increase occurring when the land portion 12 with high speed enters into the braking recess 11.

The invention can be modified within the scope of the following claims.

It is possible to provide hydraulic medium in different ways to the pressure channel, wherein the variant illustrated in FIG. 2 with continuous communication between the equalizing chamber and the drive chamber is a simple and effective solution on which can be realized without particularly complicated measures. It is, however, also realizable, within the scope of the invention, with different pressure medium sources to provide a regulating device arranged to regulate pressure and/or flow in the pressure channel such that such a pressure and flow, respectively, only exists when the braking chamber is expected to be established, as for example during idle strikes, scaling etc.

The cylinder of the rock drilling machine can be constructed otherwise and the braking chamber can be received directly in the housing instead of, as is shown in FIGS. 1-3, be arranged in a separate component.

The invention claimed is:

1. Percussion device for a hydraulic rock drilling machine (1) including, inside a cylinder (4), a to and fro moveable impact piston (3), which is provided with a land portion (12) for co-operation with a braking recess (11) in the cylinder (4) for the establishment of a braking chamber in advanced positions of the impact piston relative to a normal impact position, as seen in an impact direction (R) of the percussion device, wherein a throttle slit (17) is established between wall portions of the land portion (12) and the braking recess (11), and wherein the percussion device includes a piston guiding device (6) which is positioned in front of the braking recess (11) as seen in the impact direction (R), wherein:

a pressure channel (14), being connected to a pressure medium source, is arranged to debouch in the cylinder (4) between the piston guiding device (6) and a position of the land portion (12) in a most advanced position of the impact piston (3).

2. Percussion device according to claim 1, wherein the pressure channel (14) is arranged to debouch in an equalizing chamber (13) being arranged between the braking recess (11) and the piston guiding device (6).

3. Percussion device according to claim 2, wherein the equalizing chamber (13) is ring-shaped.

4. Percussion device according to claim 3, wherein a slit throttling (16) acting against the impact piston (3) is formed between the braking recess (11) and the equalizing chamber (13).

5. Percussion device according to claim 2, wherein a slit throttling (16) acting against the impact piston (3) is formed between the braking recess (11) and the equalizing chamber (13).

6. Percussion device according to claim 2, wherein the braking recess (11), the piston guiding device (6) and the equalizing chamber (13) are arranged in a piston guiding unit (7) which is insertable into a housing of the rock drilling machine (1).

7. Percussion device according to claim 1, wherein the pressure channel (14) is arranged to debouch in a region of the braking recess (11) being positioned most closely to the piston guiding device (6).

8. Percussion device according to claim 7, wherein in the pressure channel (14) there is arranged a one way valve (19) which is open in a direction of a mouth in the braking recess (11).

9. Percussion device according to claim 1, wherein said pressure medium source is any one from the group: a drive chamber (15) in the percussion device, a supply channel for percussion pressure, a separate high pressure generator (29).

10. Percussion device according to claim 1, wherein a regulating device is arranged to regulate pressure and/or flow in the pressure channel.

11. Percussion device according to claim 1, wherein the land portion (12) co-operating with the braking recess (11) includes a radially extending land flange (18).

12. Hydraulic rock drilling machine including a percussion device according to claim 1.

13. Method for operation of a percussion device for a hydraulic rock drilling machine (1) including, driving an impact piston (3) to and fro inside a cylinder (4), wherein a land portion (12) on the impact piston (3) co-operates with a braking recess (11) in the cylinder in advanced positions of the impact piston (3) relative to a normal impact position, as seen in an impact direction (R) of the percussion device, wherein a throttle slit (17) is established between wall portions of the land portion (12) and the braking recess (11), and wherein the impact piston is guided by a piston guiding device (6) which is positioned in front of the braking recess (11) as seen in the impact direction (R), wherein:

hydraulic medium from a pressure medium source is supplied in the cylinder (4) between the piston guiding device (6) and a position of the land portion (12) in a most advanced position of the impact piston (3).

14. Method according to claim 13, wherein the pressure medium is supplied to an equalizing chamber (13) being arranged between the braking recess (11) and the piston guiding device (6).

15. Method according to claim 14, wherein the pressure medium is supplied to a ring-shaped equalizing chamber (13).

16. Method according to claim 15, wherein in active state with the land portion (12) entering the braking recess (11), hydraulic fluid escaping from the braking recess (11) is throttled in a slit throttling (16) being formed between the braking recess (11) and the equalizing chamber (13).

17. Method according to claim 14, wherein in active state with the land portion (12) entering the braking recess (11), hydraulic fluid escaping from the braking recess (11) is throttled in a silt throttling (16) being formed between the braking recess (11) and the equalizing chamber (13).

18. Method according to claim 13, wherein the pressure medium is supplied in a region of the braking recess (11) being positioned most closely to the piston guiding device (6).

19. Method according to claim 13, wherein said hydraulic medium is supplied from any one from the group: a drive chamber (15) in the percussion device, a supply channel for percussion pressure, a separate high pressure generator (29).

20. Method according to claim 13, wherein pressure and/or flow in the pressure channel (14) is regulated.

* * * * *